US011596209B2

(12) United States Patent
Inkavesvaanit

(10) Patent No.: US 11,596,209 B2
(45) Date of Patent: Mar. 7, 2023

(54) COMPACT KEY RING

(71) Applicant: Thansit Inkavesvaanit, San Marino, CA (US)

(72) Inventor: Thansit Inkavesvaanit, San Marino, CA (US)

( * ) Notice: Subject to any disclaimer, the term of this patent is extended or adjusted under 35 U.S.C. 154(b) by 0 days.

(21) Appl. No.: 17/189,242

(22) Filed: Mar. 1, 2021

(65) Prior Publication Data

US 2022/0273077 A1 Sep. 1, 2022

(51) Int. Cl.
*A44B 15/00* (2006.01)

(52) U.S. Cl.
CPC ..... *A44B 15/007* (2013.01)

(58) Field of Classification Search
CPC ..... A44B 15/00; A44B 15/007
See application file for complete search history.

(56) References Cited

U.S. PATENT DOCUMENTS 283,464 A * 8/1883 Brown et al. ..... B66C 1/36 24/599.7
482,885 A * 9/1892 Wallace ..... F16B 45/02 24/599.1
725,322 A 4/1903 Davis
5,187,844 A * 2/1993 Simond ..... F16B 45/02 24/302
5,544,511 A * 8/1996 Cavaleri ..... A44B 15/00 70/459
5,664,304 A * 9/1997 Tambornino ..... B66C 1/36 294/82.19
5,878,834 A * 3/1999 Brainerd ..... F16B 45/02 24/DIG. 35
5,984,250 A * 11/1999 Connor ..... A47G 25/0607 294/82.19
6,421,888 B1 * 7/2002 Grenga ..... F16B 45/02 24/599.6
D467,156 S 12/2002 Bishop
6,601,274 B2 * 8/2003 Gartsbeyn ..... F16B 45/02 24/599.8
7,051,410 B2 * 5/2006 Simond ..... B66C 1/36 24/600.9
7,228,601 B2 * 6/2007 Thompson ..... F16B 45/02 24/598.2
7,353,571 B2 * 4/2008 Goldberg ..... A44C 5/2033 24/599.6
D595,119 S * 6/2009 Kelleghan ..... D8/356
D602,766 S * 10/2009 Kelleghan ..... D8/356
D608,184 S * 1/2010 Kelleghan ..... D8/356
(Continued)

*Primary Examiner* — Bayan Salone
(74) *Attorney, Agent, or Firm* — Canady & Lortz LLP; Bradley K. Lortz

(57) ABSTRACT

A key ring comprising a ring portion having a first end and second end, a rigid loop affixed to the first end, and a catch affixed to the second end for securely engaging and disengaging the rigid loop affixed to the first end is disclosed. The rigid loop and the catch can be typically disposed apart from each other with the ring portion in a relaxed state such that engaging the catch and the rigid loop holds tension between the first end and the second end to secure engagement of the catch and the rigid loop. The catch can be a hook having a tip extending into an enclosed area of the hook. The catch and the rigid loop can be oriented either in or transverse to the plane of the ring portion.

16 Claims, 10 Drawing Sheets

(56) References Cited

U.S. PATENT DOCUMENTS

| | | | | |
|---|---|---|---|---|
| 7,946,006 | B2 * | 5/2011 | Thompson | F16B 45/02 24/601.5 |
| 8,156,617 | B2 * | 4/2012 | Schwappach | F16B 45/02 24/600.1 |
| 8,763,216 | B2 * | 7/2014 | Codega | F16B 45/02 24/600.1 |
| D735,018 | S * | 7/2015 | McEvilly | D8/356 |
| 9,175,717 | B2 * | 11/2015 | Tardif | F16B 45/02 |
| 9,797,432 | B2 * | 10/2017 | Inkavesvaanit | F16B 45/02 |
| 9,958,001 | B2 * | 5/2018 | Liu | F16B 45/06 |
| 2003/0167608 | A1 * | 9/2003 | Petzl | F16B 45/02 24/600.2 |
| 2005/0011058 | A1 * | 1/2005 | Simond | B66C 1/36 24/599.1 |
| 2005/0193531 | A1 * | 9/2005 | Chang | F16B 45/02 24/600.2 |
| 2005/0229367 | A1 * | 10/2005 | Thompson | F16B 45/02 24/599.9 |
| 2008/0022497 | A1 * | 1/2008 | Thompson | F16B 45/02 24/598.1 |
| 2009/0183347 | A1 * | 7/2009 | Abels | F16B 45/02 24/599.6 |
| 2011/0113604 | A1 * | 5/2011 | Chu | F16B 45/02 24/601.5 |
| 2012/0317762 | A1 * | 12/2012 | Tardif | F16B 45/02 24/601.5 |
| 2016/0341239 | A1 * | 11/2016 | Inkavesvaanit | F16B 45/02 |
| 2016/0341240 | A1 * | 11/2016 | Liu | F16B 45/06 |

* cited by examiner

COMPACT KEY RING

BACKGROUND OF THE INVENTION

1. Field of the Invention

This invention relates to rings for holding keys for ordinary locks, such as for doors or vehicles or any other security lock. Particularly, this invention relates to system and methods for managing the organization and utility of such keys.

2. Description of the Related Art

Physical security, along with digital security, are essential considerations of modern life. People must take reasonable measures to secure their homes, their workplaces, their vehicles, and any other valuables as much as their digital information. Accordingly, a lock is typically employed to secure any significant property which could be otherwise accessed by someone without permission. Thus, an average individual will have a number of keys they must manage that are associated with the various locks they use.

A conventional pin tumbler lock will require a pin tumbler key. A pin tumbler key comprises a flat rigid, typically metal, shape having a grooved or slotted blade which has cuts thereon to engage the tumblers of the matching lock. The blade is affixed to the bow of the key which the user holds and turns when using the key. The bow of the key will commonly have a hole in it so that it can be placed on a ring to be stored and organized with other keys.

One very well known prior art ring for keys is a ring effectively made as a spring coiled onto itself. One end of the spring is pulled away from the coil in order for the hole in a key bow to be threaded onto the spring and pushed around the coil until it clears the other end. The key is now completely captured on the ring and free to move around it. Additional keys can be added. Other rings for keys may employ various types of spring loaded latches. One type of spring loaded key ring latch operates similar to a caribiner latch. Another well known type of spring loaded key ring latch employs an over center latch hooked onto a notch across an open gap in the ring.

In view of the foregoing, there is a need in the art for improved devices and methods for managing and organizing the storage of keys. There is a need for such devices to be simple and compact as well as secure. There is also a need for such devices and methods that operate reliably and efficiently over many uses and at a reduced cost. These and other needs are met by the present invention as detailed hereafter.

SUMMARY OF THE INVENTION

A key ring comprising a ring portion having a first end and second end, a rigid loop affixed to the first end, and a catch affixed to the second end for securely engaging and disengaging the rigid loop affixed to the first end is disclosed. The rigid loop and the catch can be typically disposed apart from each other with the ring portion in a relaxed state such that engaging the catch and the rigid loop holds tension between the first end and the second end to secure engagement of the catch and the rigid loop. The catch can be a hook affixed to the second end extending from the second end and turning back toward and parallel with the second end and having a tip extending into an enclosed area of the hook. The catch and the rigid loop can be oriented either in or transverse to the plane of the ring portion. The ring portion and the catch can be wire electro discharge machining (EDM) cut from a single metal piece, such as titanium.

A typical embodiment of the invention comprises a compact key ring is disclosed having a ring portion having a first end and second end, a rigid loop affixed to the first end; and a catch affixed to the second end for securely engaging and disengaging the rigid loop affixed to the first end. The rigid loop and the catch can be typically disposed apart from each other with the ring portion in a relaxed state such that engaging the catch and the rigid loop holds tension between the first end and the second end to secure engagement of the catch and the rigid loop. The ring portion can comprise a circular ring or a pillow shape (comprising a plurality of circular segments each having a larger diameter than the inner diameter of the ring portion). The one or more elements of the key ring can comprise titanium. The rigid loop can be transverse to or in a plane of the ring portion. Similarly, in order to properly engage the rigid loop, the catch can also be either transverse to or in a plane of the ring portion.

In some embodiments, the catch can comprise a hook affixed to the second end. The hook extends from the second end and turns back toward and parallel with the second end and has a tip extending into an enclosed area of the hook. The rigid loop and the ring portion can comprise a contiguous casting. Alternately, the rigid loop can comprise a snap fit engagement to the first end. The first end can comprise two holes and the snap fit engagement can comprise a snap fit element for each of the two holes. The ring portion and the hook can be wire electro discharge machining (EDM) cut from a single metal piece. These apparatus embodiments of the invention can be further modified consistent with the any other embodiment of the invention described herein.

In some embodiments employing the hook, the hook can turn back toward and parallel with the second end by turning in a plane of the ring portion. The hook can turn in the plane of the ring portion toward an interior area of the ring portion.

In other embodiments employing the hook, the hook turns back toward the second end by turning out of a plane of the ring portion. The rigid loop can be in the plane of the ring portion.

In a further embodiment of the invention, the rigid loop can comprise a slotted opening having a larger opening toward the first end of the ring portion and the catch can comprise a pin having a head, the head capable of fitting through the larger opening. The pin can point out of a plane of the ring portion and the rigid loop is in the plane of the ring portion. These apparatus embodiments of the invention can be further modified consistent with the any other embodiment of the invention described herein.

BRIEF DESCRIPTION OF THE DRAWINGS

Referring now to the drawings in which like reference numbers represent corresponding parts throughout.

DETAILED DESCRIPTION OF THE PREFERRED EMBODIMENT

1. Overview

Figure 1B:
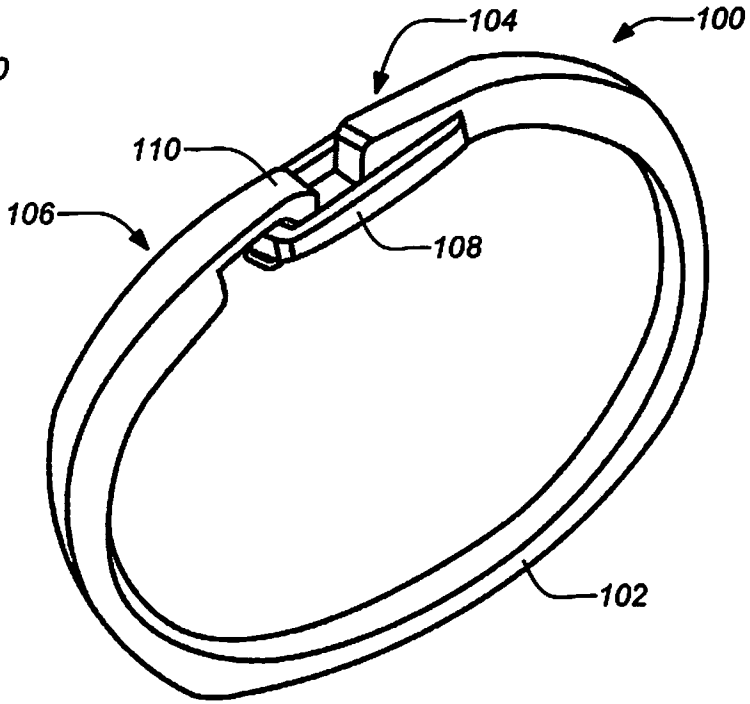
FIG. 1B illustrates an isometric view of an exemplary key ring embodiment having a vertical hook and loop engagement in the closed position.

As previously mentioned, embodiments of the invention comprise a compact key ring having a ring portion having a first end and second end, a rigid loop affixed to the first end, and a catch affixed to the second end for securely engaging and disengaging the rigid loop affixed to the first end is disclosed. The rigid loop and the catch can be typically disposed apart from each other with the ring portion in a relaxed state such that engaging the catch and the rigid loop holds tension between the first end and the second end to secure engagement of the catch and the rigid loop. The ring portion and the catch can be wire electro discharge machining (EDM) cut from a single metal piece, such as titanium. The form of the catch can be varied as well as the orientation of the catch relative to the ring portion.

In one example, the catch can be a hook affixed to the second end extending from the second end and turning back toward and parallel with the second end and having a tip extending into an enclosed area of the hook. The catch and the rigid loop can be oriented either in or transverse to the plane of the ring portion.

In another example, the catch can be a pin head. In this case, the rigid loop is formed having a slotted opening with a larger opening toward the first end of the ring portion in order to accept the head of the pin. The pin then slides into the narrower end of the slot to be securely engaged.

As will be described hereafter, one significant variable in the key ring embodiments of the invention involves the orientation of the catch and loop relative to the ring portion of the key ring. The ring portion is the main body which carries one or more keys in use. Generally, there are four possible orientations which are described below. The different orientations can be described relative to the plane of the ring portion. The catch and loop are orthogonal to one another. The orientation of the catch is defined by the plane of either the hook arc or the pin. The orientation of the loop is defined by the plane of the loop. Thus, if the catch is disposed in the plane of the ring portion, the loop is disposed out of the plane of the ring portion. See, e.g. FIG. 1A. On the other hand, if the catch is disposed out of the plane of the ring portion, the loop is then in the plane of the ring portion. See, e.g. FIG. 3A.

There are technically two possible variants with the catch out of the plane of the ring portion and the loop in the plane being mirror images of one another, i.e. the catch and loop are inverted on their ring portion ends. However, the difference between these two variants is likely to go unnoticed in most cases and therefore those skilled in the art will appreciate that these two variants will be considered identical although only one variant may be illustrated herein. Thus, the figures disclosed here should also be considered to comprise the mirror images of these figures as will be understood by those skilled in the art.

The two possible variants with the catch in the plane of the ring portion and the loop out of the plane are more distinct. In this case, the catch (being a hook or pin) will be directed either into or out of the ring portion area. The example figures show only embodiments where the catch is directed into the ring portion area. Although these two variants are not simply mirror images of one another, those skilled in the art will readily understand from the example figures herein how the catch and loop can be simply inverted on their ring portion ends to yield the alternate variant.

2. Exemplary Compact Key Ring

Figure 1A:
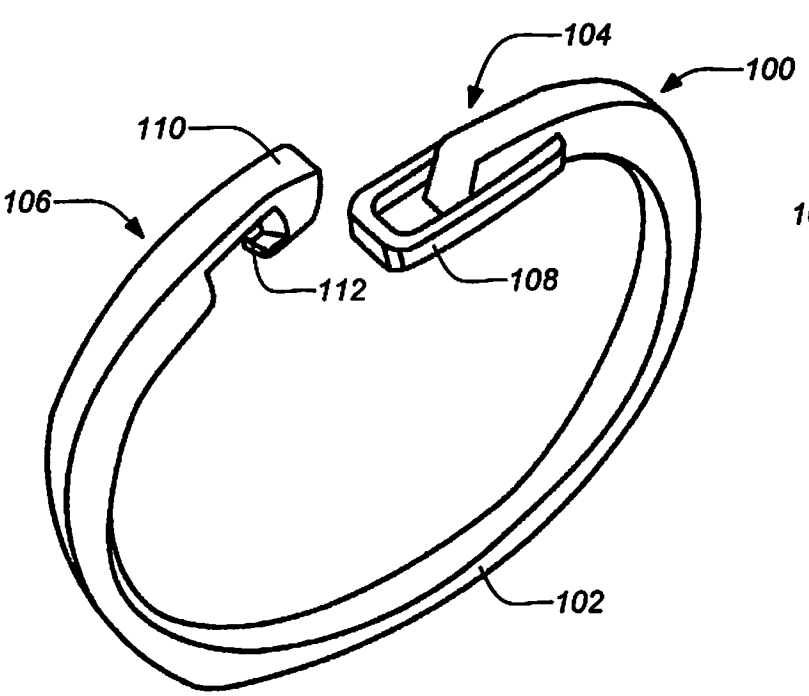
FIG. 1A illustrates an isometric view of an exemplary key ring embodiment having a vertical hook and loop engagement in the open position.

FIGS. 1A-1F illustrate various views of an exemplary key ring 100 embodiment employing a catch as a vertical hook 110 and loop 108 engagement, i.e. with the hook 110 in the plane of the ring portion 102 and the rigid loop 108 oriented out of the plane of the ring portion 102. FIG. 1A illustrates an isometric view of an exemplary key ring 100 embodiment with the hook 110 and loop 108 in the open position, i.e. disengaged. The ring portion 102 forms a nearly closed geometric shape having a first end 104 and second end 106. Typically, although not necessarily, the shape of the inner surface of the ring portion 102 is circular. The shape of the outer surface of the ring portion 102 can be also, but not necessarily, circular as well. In some cases, the outer surface can be a "pillow shape" comprising a plurality of circular segments (e.g. four) each having a larger diameter than the inner diameter of the ring portion. A rigid loop 108 is affixed to the first end 104 and a catch (e.g. hook 110) is affixed to the second end 106. The catch is designed to be securely engaged and disengaged from the rigid loop 108 affixed to the first end 104 by a user. When engaged the catch should not become inadvertently disengaged from the rigid loop 108. In order to aid in preventing inadvertent disengagement, the rigid loop 108 and the catch (hook 110) are disposed apart from each other with the ring portion 102 in a relaxed state as shown in FIG. 1A, 1E, 3A, 4A, 4B or 6.

Figure 1D:
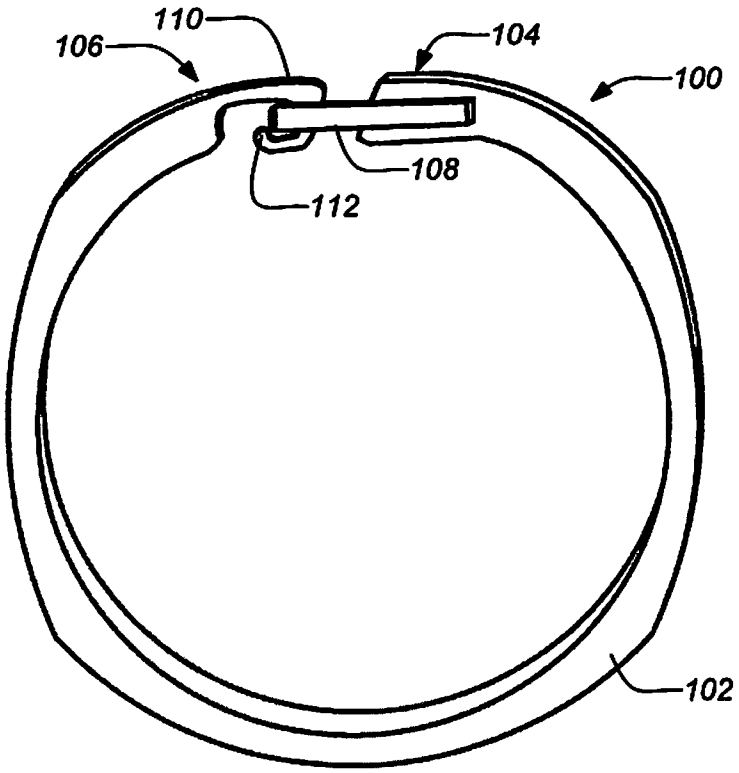
FIG. 1D illustrates a side view of an exemplary key ring embodiment having a vertical hook and loop engagement in the closed position.
Figure 1C:
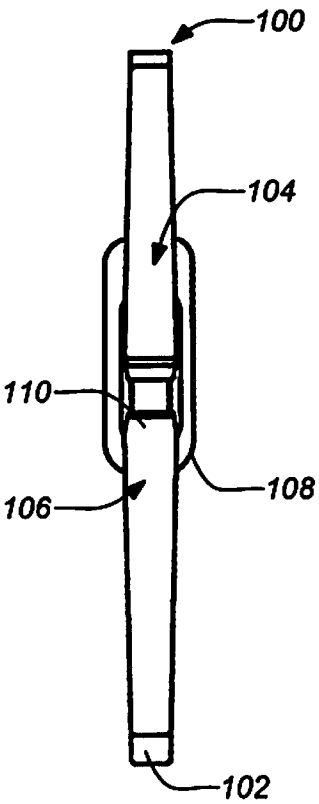
FIG. 1C illustrates a top view of an exemplary key ring embodiment having a vertical hook and loop engagement in the closed position.

FIG. 1B illustrates an isometric view of an exemplary key ring 100 embodiment having a vertical hook and loop engagement in the closed position. The hook 110 is described as "vertical" because it is in the plane of the ring portion 102. Accordingly, the rigid loop 108 is transverse to the plane of the ring portion 102. Significantly, the hook 110 extends from the second end and turning back toward and parallel with the second end and has a tip 112 extending into the enclosed area of the hook 110. This tip 112 helps to prevent inadvertent disengagement of the loop 108 because the edge of the loop 108 must be lifted over this tip 112 to be disengaged in opposition to the tension created in the engaged hook 110 and loop 108. As mentioned above, because the rigid loop 108 and the hook 110 are disposed apart from each other with the ring portion 102 in a relaxed state, engaging the catch (hook 110 or pin 304) and the rigid loop 108 holds tension between the first end 104 and the second end 106 securing engagement of the catch and the rigid loop 108 by forcing the catch to remain in the engaged position within the rigid loop 108. FIGS. 1C and 1D illustrate a top and side view, respectively, of an exemplary key ring 100 embodiment having a vertical hook 110 and loop 108 engagement in the closed position.

Figure 1F:
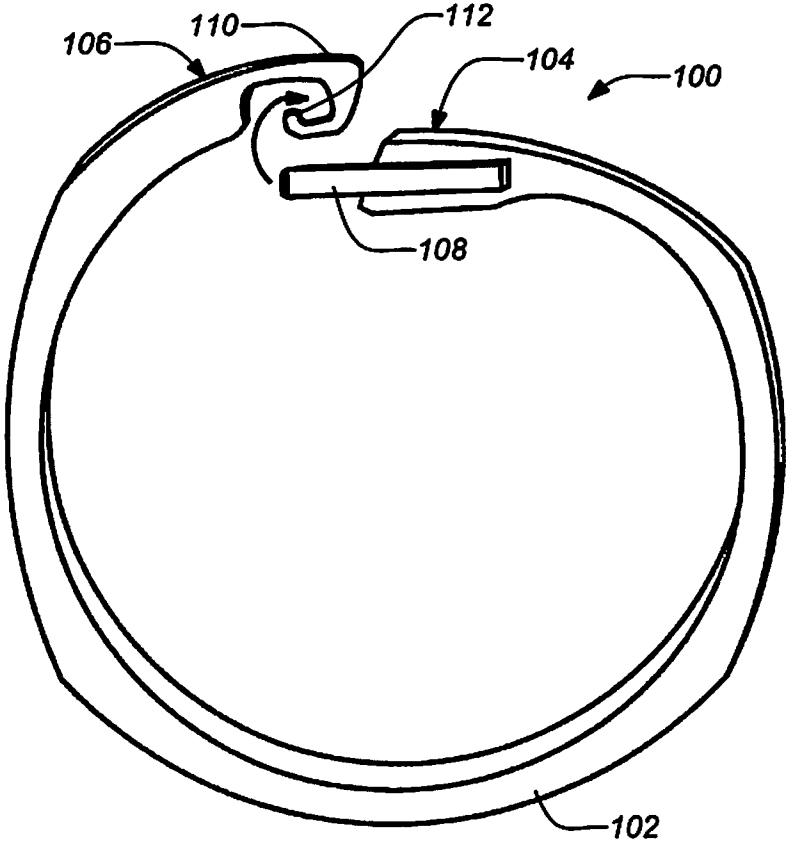
FIG. 1F illustrates a side view of an exemplary key ring embodiment having a vertical hook and loop engagement showing temporary distortion of the ring in order to close the latch.
Figure 1E:
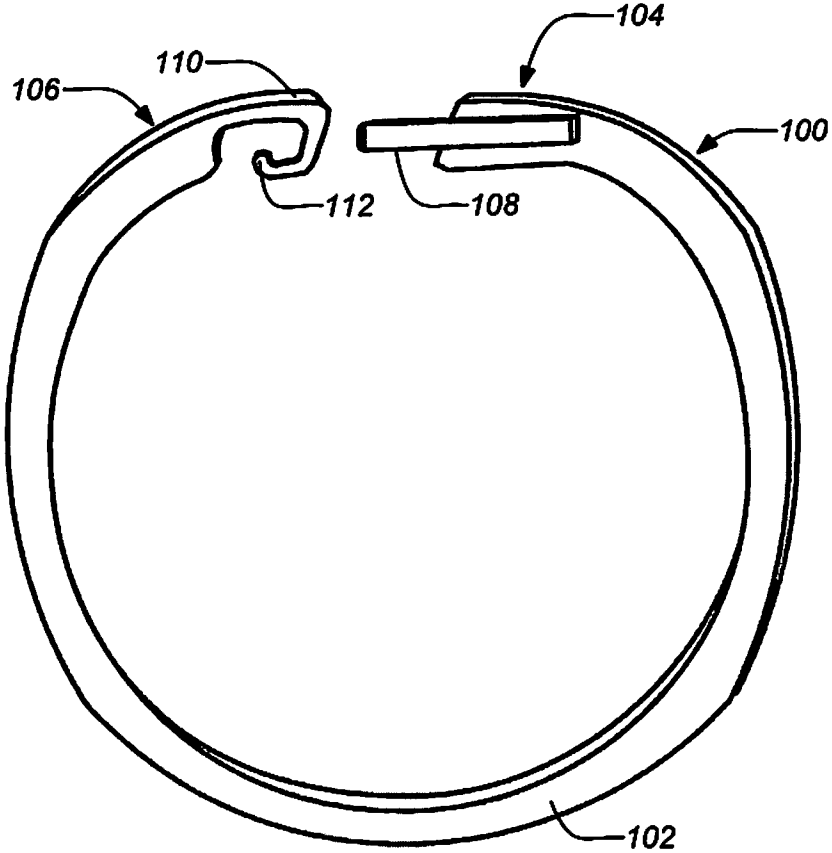
FIG. 1E illustrates a side view of an exemplary key ring embodiment having a vertical hook and loop engagement in the open position.

FIG. 1E illustrates a side view of an exemplary key ring embodiment having a vertical hook 110 and loop 108 engagement in the open position with the ring portion 102 in a relaxed state. FIG. 1F illustrates a side view of an exemplary key ring 100 embodiment showing temporary distortion of the ring portion 102 in order to engage the hook 110 with the loop 108 by moving the loop 108 along the direction of the arrow.

Figure 2:
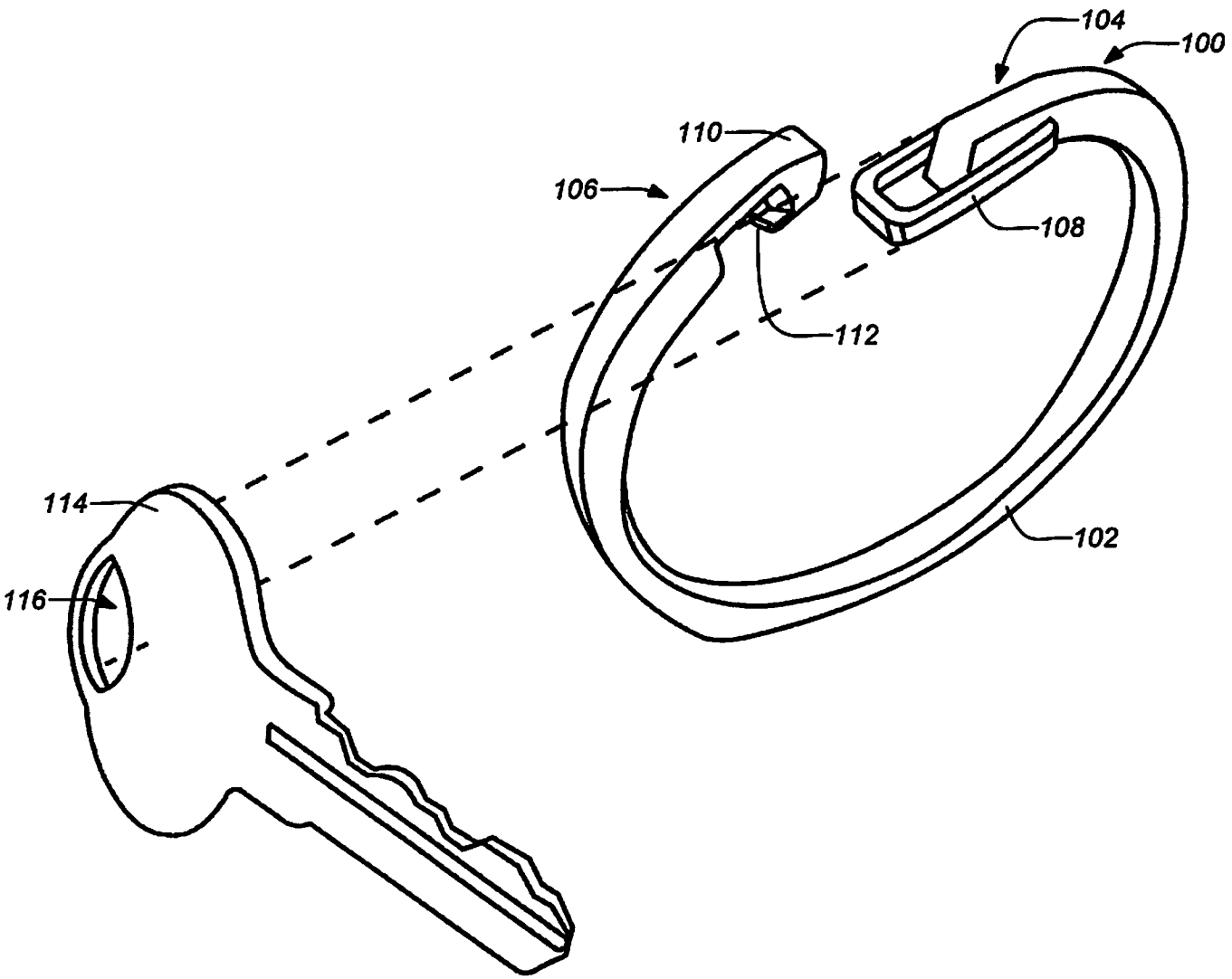
FIG. 2 illustrates an isometric view of an exemplary key ring embodiment having a vertical hook and loop engagement in the open position showing how a hole in a key bow is threaded onto the ring.

FIG. 2 illustrates an isometric view of an exemplary key ring 100 embodiment showing how a hole 116 in a key bow 114 is threaded onto the ring 100 with the ring portion 102 in a relaxed state prior to engagement of the hook 110 and the loop 108 to secure the key on the ring 100 as previously described.

Figure 3B:
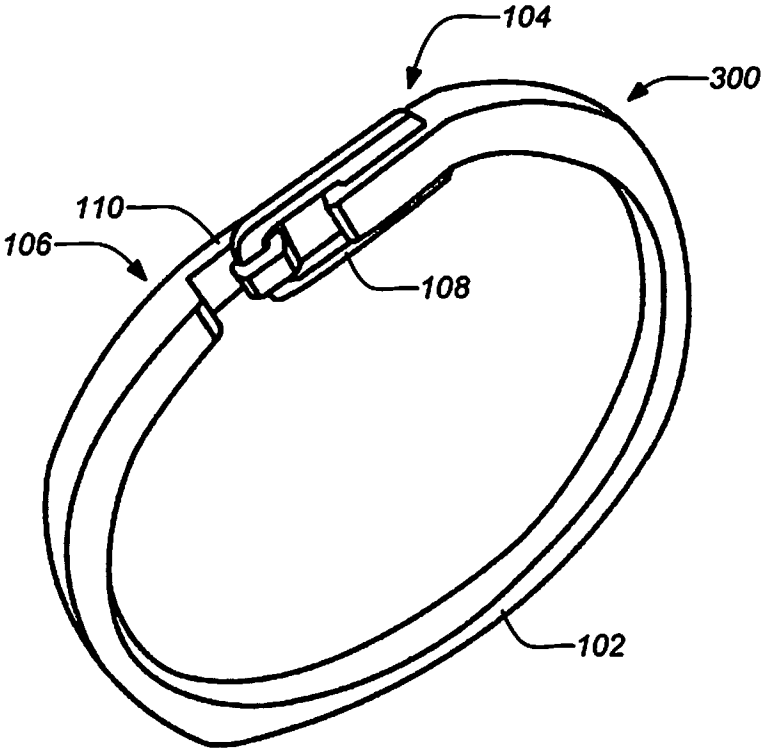
FIG. 3B illustrates an isometric view of an exemplary key ring embodiment having a horizontal hook and loop engagement in the closed position.
Figure 3A:
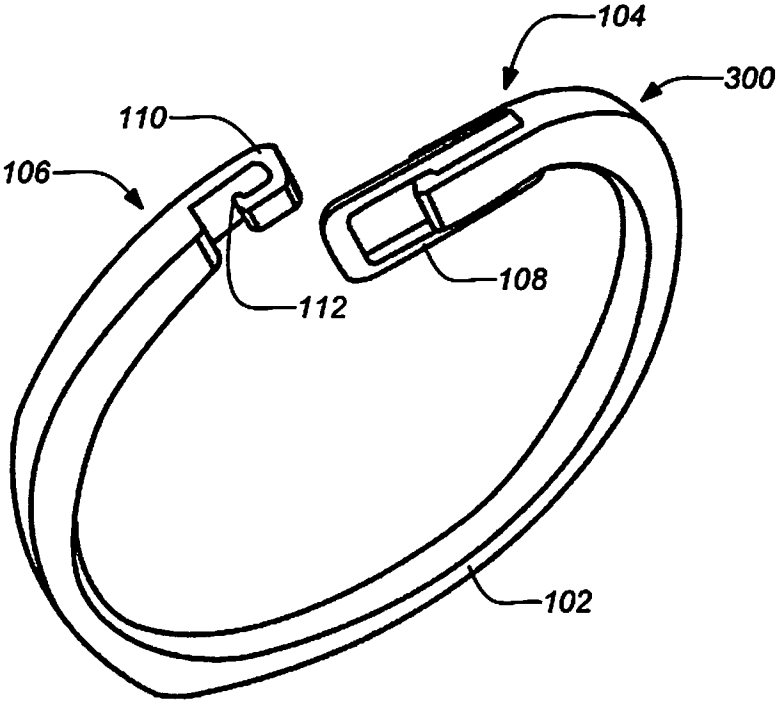
FIG. 3A illustrates an isometric view of an exemplary key ring embodiment having a horizontal hook and loop engagement in the open position.
Figure 3D:
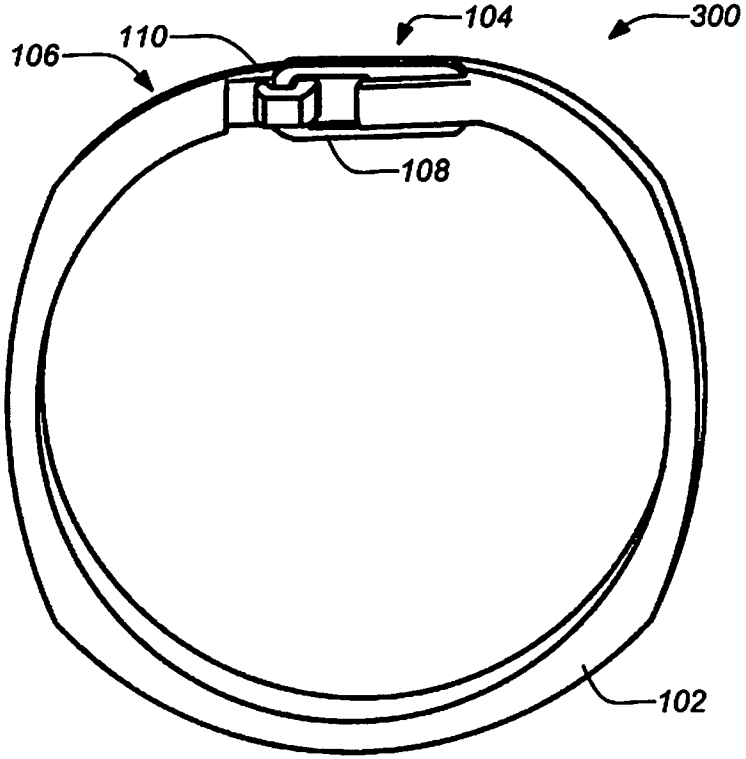
FIG. 3D illustrates a side view of an exemplary key ring embodiment having a horizontal hook and loop engagement in the closed position.
Figure 3C:
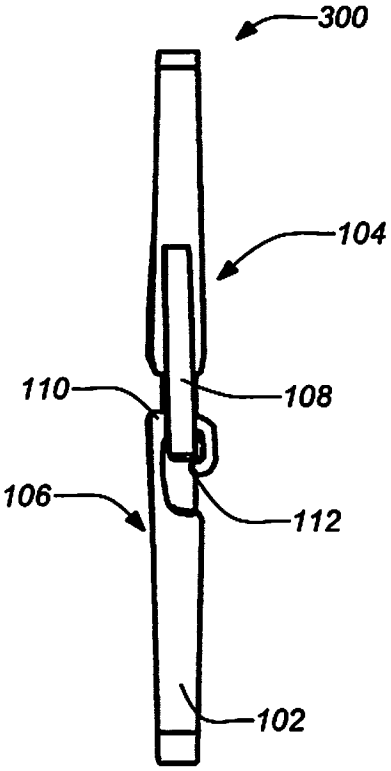
FIG. 3C illustrates a top view of an exemplary key ring embodiment having a horizontal hook and loop engagement in the closed position.

FIGS. 3A-3D illustrate various views of another exemplary key ring 300 embodiment having a horizontal hook 110 and loop 108 engagement. The hook 110 is "horizontal" in this case because the hook 110 is transverse to the plane of the ring portion 102 while the rigid loop 108 is now in the plane of the ring portion 102. FIG. 3A illustrates an isometric view of an exemplary key ring 300 embodiment having a horizontal hook 110 and loop 108 engagement in the open position with the ring portion 102 in a relaxed state. FIG. 3B illustrates an isometric view of an exemplary key ring 300 embodiment having a horizontal hook 110 and loop 108 engagement in the closed position with the ends 104, 106 under tension thereby securing the engagement. FIGS. 3C and 3D illustrate a top and side view, respectively, of an exemplary key ring 300 embodiment having a horizontal hook 110 and loop 108 engagement in the closed position.

Figure 4A:
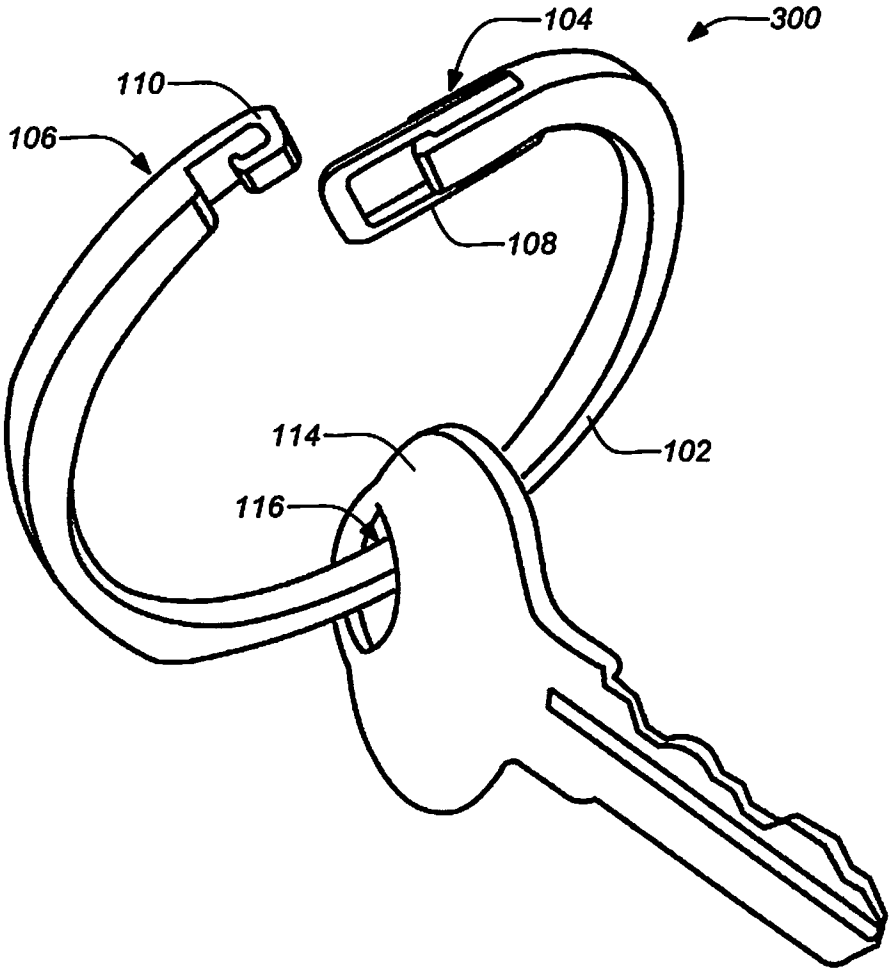
FIG. 4A illustrates an isometric view of an exemplary key ring embodiment having a horizontal hook and loop engagement in the open position showing a key threaded onto the ring.
Figure 4B:
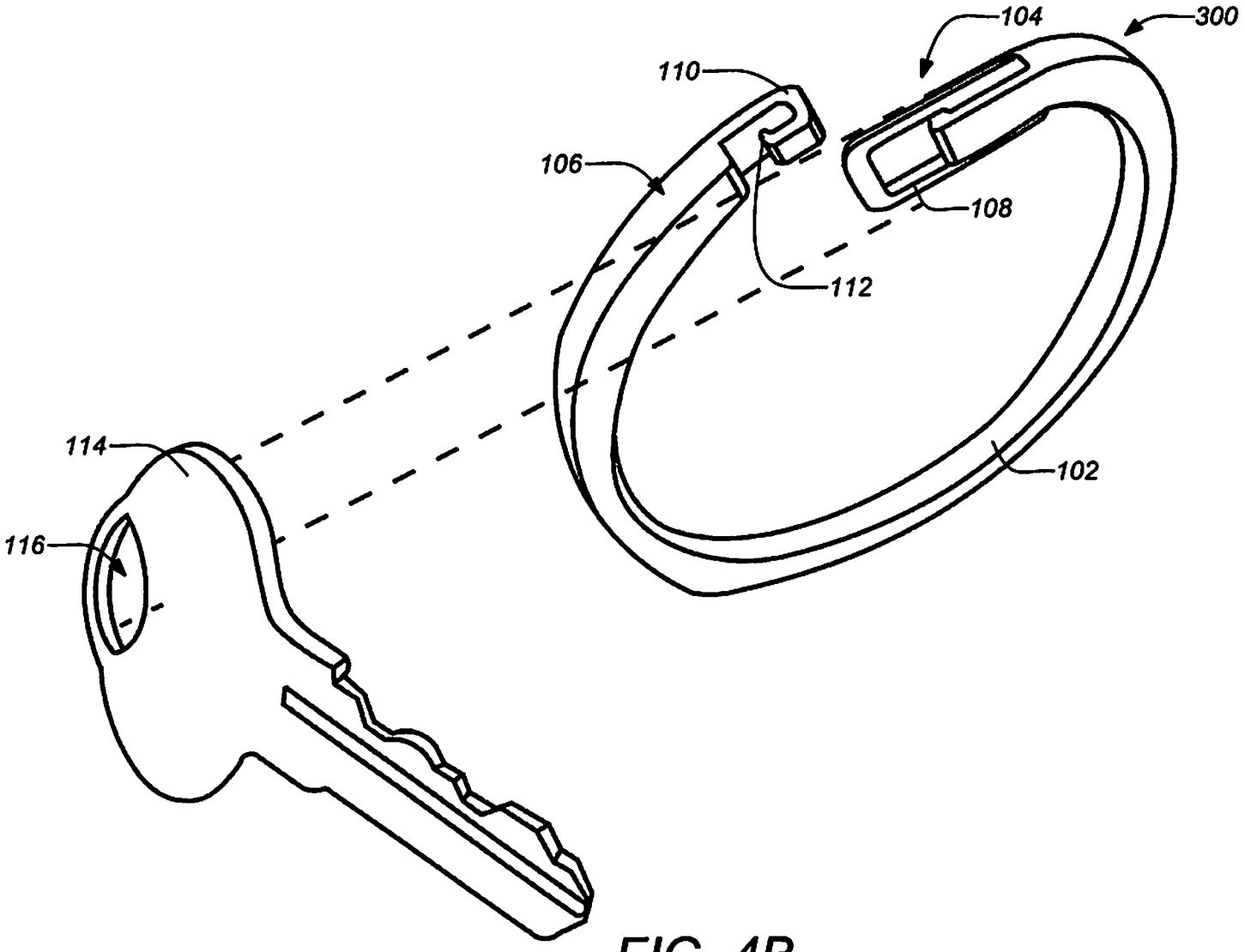
FIG. 4B illustrates an isometric view of an exemplary key ring embodiment having a horizontal hook and loop engagement in the open position showing how a hole in a key bow is threaded onto the ring.

FIGS. 4A and 4B illustrate views of the exemplary key ring 300 embodiment having a horizontal hook 110 and loop 108 engagement showing a key threaded onto the ring 200. The ring portion 102 is threaded the hole 116 in the key bow 114 with the hook 110 disengaged from the loop 108 and the ring portion 102 in a relaxed state.

Figure 5A:
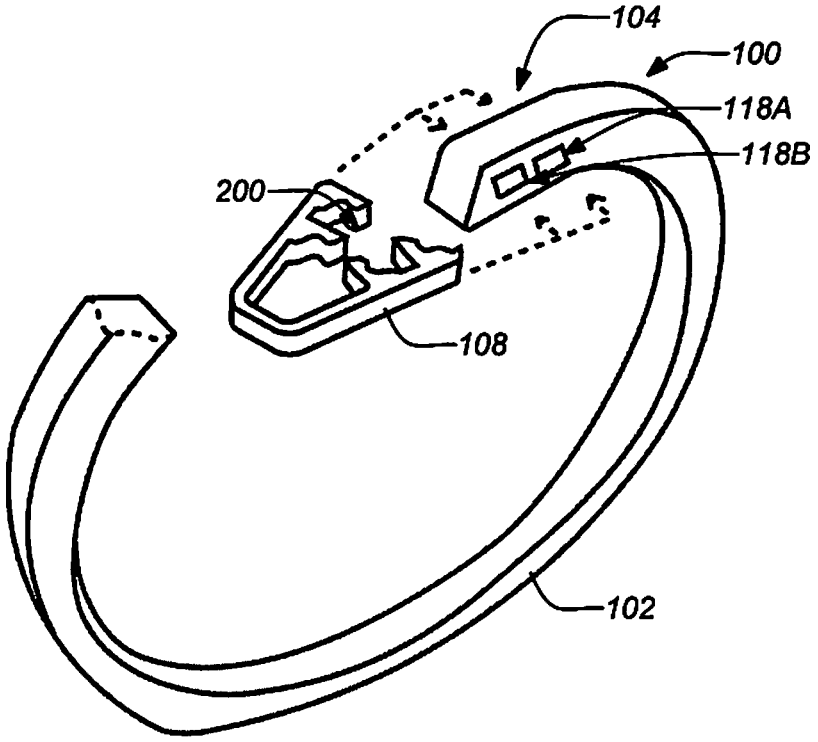
FIG. 5A illustrates an isometric view of an exemplary key ring embodiment having a vertical hook and loop engagement showing assembly of a snap fit loop element for engaging hole in one end of the ring.
Figure 5B:
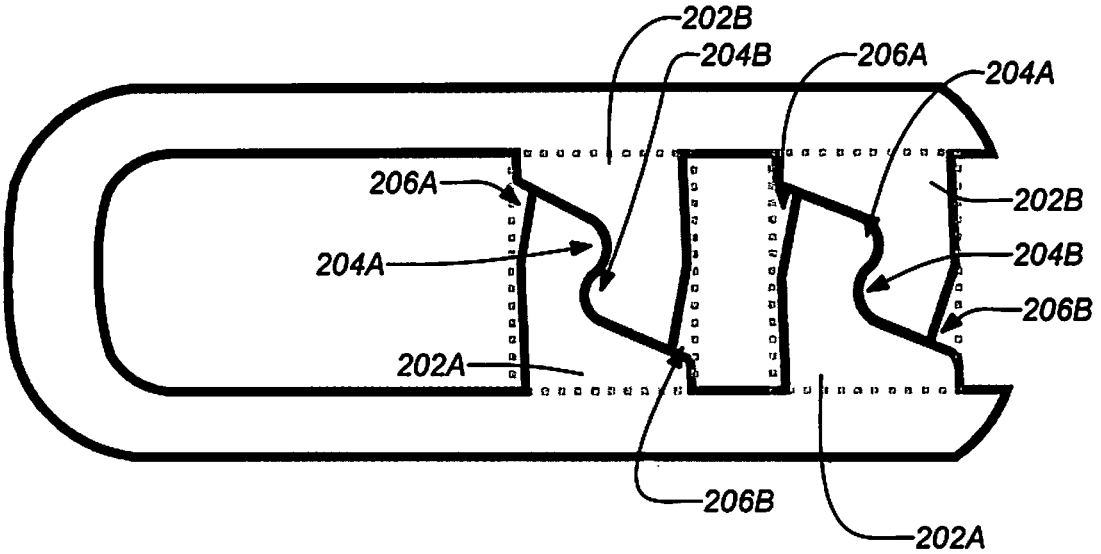
FIG. 5B illustrates a close up cross section of the snap fit loop element engaged through holes in one end of the ring.

FIG. 5A illustrates an isometric view of an exemplary key ring 100 embodiment having a vertical hook 110 and loop 108 engagement showing assembly of a snap fit loop element 200 for engaging holes 118A, 118B in first end 104 of the ring portion 102. (Note that the hook 110 is not shown but identical to the hook 110 depicted in FIGS. 1A-1F and 2.) FIG. 5B illustrates a close up cross section of the snap fit loop element 200 engaged through holes 118A, 118B in the end 104 of the ring portion 102. In this example, the holes 118A, 118B are cut as rectangular shapes, e.g. using EDM. The shape of these holes 118A, 118B allows separate snap fit loop elements 200 to engage each hole 118A, 118B. As shown, each snap fit loop element 200 comprises a pair of mirror image shapes 202A, 202B having interlocking high spots 204A, 204B. Importantly, the shapes 202A, 202B also include small spaces 206A, 206B backing the high spots 204A, 204B within the holes 118A, 118B so that the high spots 204A, 204B can clear each other and snap into place when as both opposing shapes 202A, 202B are pressed into the holes 118A, 118B from opposite sides. Note that any other suitable snap fit forms can also be used as will be understood by those skilled in the art.

Figure 5C:
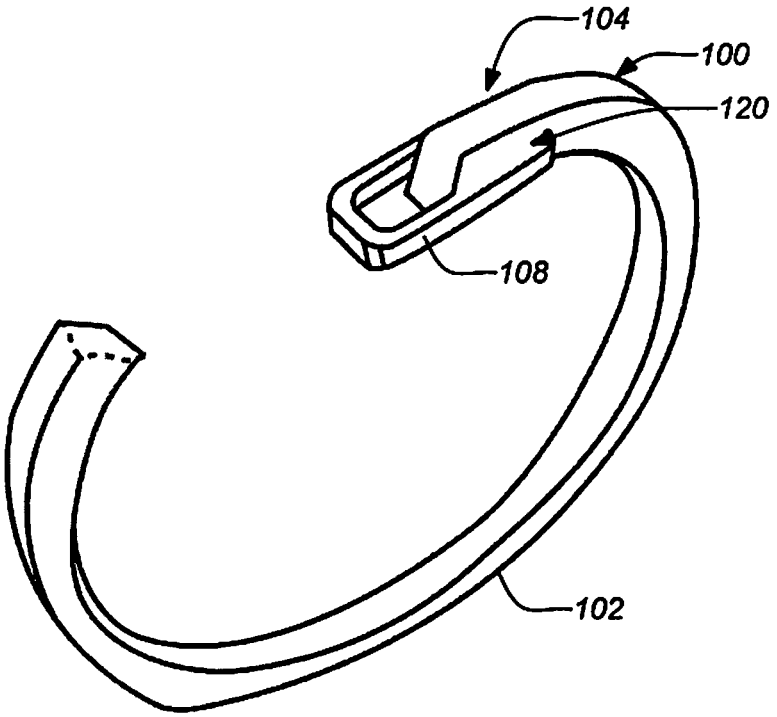
FIG. 5C illustrates an isometric view of an exemplary key ring embodiment having a vertical hook and loop engagement showing a casting forming the loop element at one end of the ring.

FIG. 5C illustrates an isometric view of an exemplary key ring embodiment having a vertical hook 110 and loop 108 engagement showing a casting forming the loop 108 element at one end of the ring portion 102. (Note that the hook 110 is not shown but identical to the hook 110 depicted in FIGS. 1A-1F and 2.) In this case, the rigi loop 108 can be formed along with the ring portion 102 as a single casting, e.g. of metal, or a single molded part, e.g. of plastic or polymer. The opposing hook 110 can also be molded or separately machined at the other end 106 of the ring portion 102.

Figure 6:
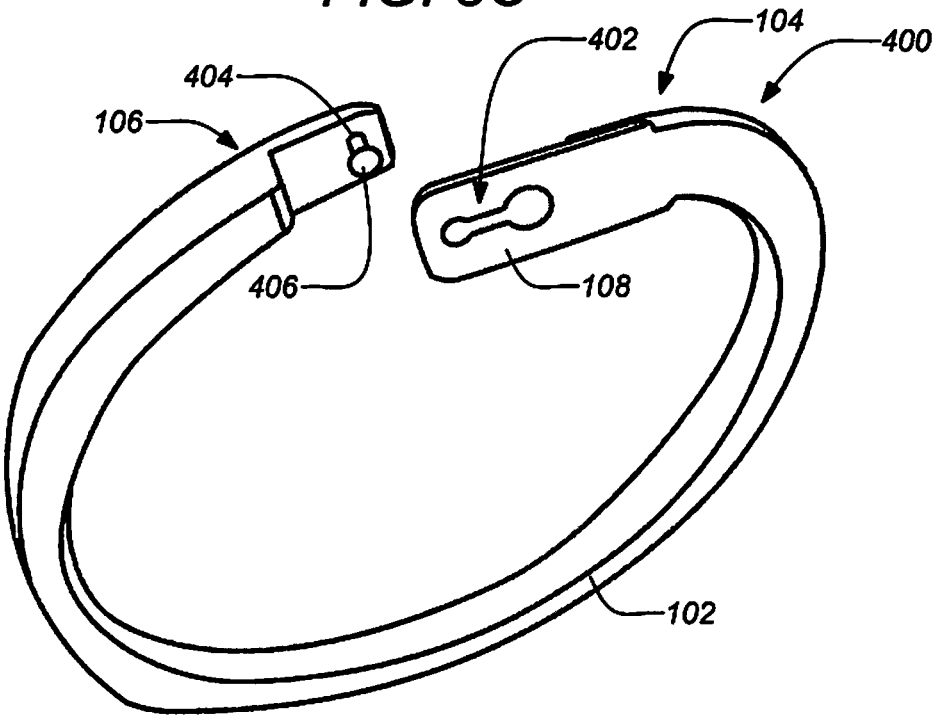
FIG. 6 illustrates an isometric view of an exemplary key ring embodiment having an alternate horizontal slot and pin head engagement.

FIG. 6 illustrates an isometric view of an alternate exemplary key ring 400 embodiment having rigid loop 108 in the form a slotted opening 402 and catch in the form of a pin 404 having a head 406. The pin 404 is vertical, i.e. transverse to the plane of the ring portion 102, while the loop 108 is in the plane of the ring portion 102. Typically, the slotted opening 402 has a larger opening toward the first end 104 of the ring portion 102 which is smaller at the other end. The head 406 of the pin 404 is capable of fitting through the larger opening but not the smaller end. Since the ends 104, 106 of the ring portion 102 are in tension when the pin 404 is engaged with the slotted opening 402, the tension holds the pin 404 at the smaller end where the head 406 cannot pass through the opening 402. Thus, the loop 108 and catch of this ring 400 are also naturally prevented from inadvertent disengagement after being engaged together by a user. It should be noted that this ring 400 can be similarly alternately produced to have the pin 404 in the plane of the ring portion 102 directed toward the area of the ring portion 102 with the loop 108 transverse to the plane of the ring portion 102 as will be understood by those skilled in the art. In addition, both these variants can also be made with the pin 404 directed in the inverse direction, i.e. toward the opposite side out of the plane of the ring portion 102 or with the pin 404 directed out of the area of the ring portion 102 as will be understood by those skilled in the art.

The various embodiments of the invention described can be produced from any suitable resilient, durable materials. The key rings can be produced from elastic metals, plastics, or polymers. The material should be hard but also with sufficient spring to support engaging and disengaging of the catch and loop. Some example suitable metals include titanium or beryllium copper. However, casting, powder injection molding is also possible with titanium, stainless steel or other suitable metals or plastics. Composite materials can also be employed. For example, a steel or titanium core wrapped with a polycarbonate, e.g. a polycarbonate (or polymer) injected over a metal core. This type of construction will enable colorful designs in the polycarbonate or polymer.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention can be devised without departing from the inventive concept as set forth in the following claims.

What is claimed is:

1. An apparatus, comprising:

a ring portion having a first end and second end and a contiguous solid between the first end and the second end;

a rigid loop affixed to the first end such that the rigid loop and the first end of the ring portion do not move relative to one another; and a catch affixed to the second end for securely engaging and disengaging the rigid loop affixed to the first end;

wherein the rigid loop and the catch are disposed apart from each other with the ring portion in a relaxed state such that engaging the catch and the rigid loop holds tension between the first end and the second end to secure engagement of the catch and the rigid loop and temporary distortion of the ring portion allows the catch and the rigid loop to engage.

2. The apparatus of claim 1, wherein the ring portion comprises a pillow shape.

3. The apparatus of claim 1, wherein at least the ring portion comprises titanium.

4. The apparatus of claim 1, wherein the rigid loop is transverse to a plane of the ring portion.

5. The apparatus of claim 1, wherein the rigid loop is in a plane of the ring portion.

6. The apparatus of claim 1, wherein the catch comprises a hook affixed to the second end, the hook extending from the second end and turning back toward and parallel with the second end and having a tip extending into an enclosed area of the hook.

7. The apparatus of claim 6, wherein the rigid loop and the ring portion comprise a contiguous casting.

8. The apparatus of claim 6, wherein the rigid loop comprises a snap fit engagement to the first end.

9. The apparatus of claim 8, wherein the ring portion and the hook are wire electro discharge machining (EDM) cut from a single metal piece.

10. The apparatus of claim 8, wherein the first end comprises two holes and the snap fit engagement comprise a snap fit element for each of the two holes.

11. The apparatus of claim 6, wherein the hook turns back toward and parallel with the second end by turning in a plane of the ring portion.

12. The apparatus of claim 11, wherein the hook turns in the plane of the ring portion toward an interior area of the ring portion.

13. The apparatus of claim 6, wherein the hook turns back toward the second end by turning out of a plane of the ring portion.

14. The apparatus of claim 13, wherein the rigid loop is in the plane of the ring portion.

15. The apparatus of claim 1, wherein the rigid loop comprises a slotted opening having a larger opening toward the first end of the ring portion and the catch comprises a pin having a head, the head capable of fitting through the larger opening.

16. The apparatus of claim 15, wherein the pin points out of a plane of the ring portion and the rigid loop is in the plane of the ring portion.

* * * * *